US006324368B1

(12) United States Patent
Seto

(10) Patent No.: US 6,324,368 B1
(45) Date of Patent: Nov. 27, 2001

(54) IMAGE FORMING APPARATUS HAVING A FIRST SQUEEZE ROLLER ROTATED IN AN OPPOSITE DIRECTION TO A PHOTOSENSITIVE MEMBER

(75) Inventor: Shoko Seto, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/515,711

(22) Filed: Feb. 29, 2000

(51) Int. Cl.[7] ..... G03G 15/10
(52) U.S. Cl. ..... 399/249; 15/256.51
(58) Field of Search ..... 15/256.51, 256.52; 118/652; 399/249, 251, 302

(56) References Cited

U.S. PATENT DOCUMENTS

| | | | | |
|---|---|---|---|---|
| 5,335,054 | | 8/1994 | Landa et al. . | |
| 5,576,815 | | 11/1996 | Teschendorf et al. . | |
| 5,713,068 | * | 1/1998 | Teschendorf et al. | 399/249 |
| 5,758,236 | * | 5/1998 | Teschendorf et al. | 399/249 |
| 5,839,037 | * | 11/1998 | Larson et al. | 399/249 |

* cited by examiner

*Primary Examiner*—Arthur T. Grimley
*Assistant Examiner*—Hoang Ngo
(74) *Attorney, Agent, or Firm*—Foley & Lardner

(57) ABSTRACT

An image forming apparatus according to the present invention includes a first squeeze roller faced to the photosensitive member with a predetermined distance maintained therefrom and rotated in a direction opposite to a rotating direction of the photosensitive member, thereby to remove a surplus developing solution which exists on the photosensitive member after development, and a second squeeze roller provided in contact with the photosensitive member and rotated in the same direction as the photosensitive member with no speed difference therebetween as the photosensitive member rotates, thereby to remove a solvent contained in a toner image formed by developing the latent image. The first squeeze roller is rotated at a moving speed which is 2 to 3 times higher than a speed at which the outer circumferential surface of the photosensitive member moves. The second squeeze roller is pressed against the outer circumferential surface of the photosensitive member with a pressure which provides a nip width of 1 to 2 mm. As a result of this, a solvent film which does not contain the toner in which the floating toner that has not stuck to the latent image or the developing roller remains, and a solvent remaining between toner grains accumulated on the latent image are removed.

18 Claims, 4 Drawing Sheets

IMAGE FORMING APPARATUS HAVING A FIRST SQUEEZE ROLLER ROTATED IN AN OPPOSITE DIRECTION TO A PHOTOSENSITIVE MEMBER

BACKGROUND OF THE INVENTION

The present invention relates to a developing apparatus for a wet image forming apparatus which uses a developing solution in which toner is dispersed in a solvent and which is capable of removing a surplus developing solution or solvent remaining on a photosensitive material after development, divided into a non-image part and an toner part, among image forming apparatuses represented by, for example, an electrophotographic copy machine, a laser beam printer, and the like.

The wet image forming apparatus using a developing solution in which toner is dispersed uses a developer in which toner grains consisting of resin and pigment are dispersed in a mainly petroleum-based non-polar solvent and the toner is charged to a predetermined electric potential by a charge support agent added to a solvent liquid. The wet image forming apparatus attracts attention now since image quality can be more improved because of the small grain diameter of and less energy can be necessary for fixing because of the lower resin content rate of the toner, in comparison with a dry image forming apparatus (magnetic brush type development method) which has been spreading widely.

A conventional wet image forming apparatus uses an electric field transfer method as follows. In a state where a surplus developer remaining after development is squeezed slightly, i.e., where a solvent remains to some extent, the surplus developer is conveyed to a transfer area where a photosensitive drum (transfer medium) and a developing roller face each other with a predetermined gap maintained therebetween. A condition is prepared such that the gap between the roller and the transfer medium is filled with a solvent. The developer is transferred to a photosensitive member, utilizing a fact that toner causes electrophoresis due to an electric field applied to the transfer medium, under the condition described above.

In this electric field transfer method, problems lie in that the toner image can be easily disturbed during transfer, a surplus solvent moves to the transfer medium and can not be collected sufficiently, and the like.

To solve the problems, developments have been made in an offset transfer method which does not utilizes electrophoresis during transfer but utilizes heat and/or pressure to achieve transfer.

In this offset transfer method, the toner image is completely dried prior to the transfer so that the toner image cannot be disturbed. In addition, a solvent having an odor or inflammability can be collected in the first half of the image forming process. Therefore, the offset transfer method is more advantageous than the electric field transfer method.

In the offset transfer method described above, the toner image on a photosensitive member has to be dried to a desired degree during a period from development to transfer, so that a squeeze roller is used together with a drying blower in many cases.

As an example of the wet image forming apparatus using a squeeze roller, a squeeze method of squeezing away a carrier solution on the photosensitive member by using an elastic roller is disclosed in the U.S. Pat. No. 5,576,815.

The squeeze roller removes a surplus liquid film in the following manner. The squeeze roller is installed immediately behind a developing area where the photosensitive member and the developing roller face each other with a slight gap maintained from the photosensitive member, and is rotated in an against direction which is opposite to the rotation direction of the photosensitive member at the position where the squeeze roller faces the photosensitive member, at the speed in the range which is 2 to 4 times higher than the circumferential speed ratio which is a difference of the moving speed of the outer circumferential surface of the squeeze roller with respect to the moving speed of the photosensitive member.

However, to remove a much larger amount of solvent, a problem arises in that such an image defect is caused that trails the image itself backward in the rotating direction because toner grains accumulated on the latent image are removed together with the solvent and an accumulated toner layer is thereby broken.

There is a limitation to the amount of surplus developing solution (thickness of a film) that can be removed without causing the image defect. Treatments such as increasing of an output of the drying blower, heating, extension of a time up to transfer, and the like are necessary to remove a desired amount of a remaining developing solution prior to the transfer step.

However, any of the treatments will cause a problem with respect to high-speed processing or power saving.

BRIEF SUMMARY OF THE INVENTION

An object of the present invention is to provide a wet electrophotographic developing apparatus which removes rapidly a surplus developing solution from a photosensitive member and a toner layer without disturbing a toner image and is capable of low power consumption and high-speed processing.

The present invention has been made on the basis of the problems described above and provides an image forming apparatus for developing a latent image on a photosensitive member with use of a liquid developer in which toner grains are dispersed in a solvent and for transferring a toner image formed on the photosensitive member to a transfer medium by means of a heat, a pressure, or a heat and a pressure, the apparatus comprising: a developing apparatus including a first squeeze roller faced to the photosensitive member with a predetermined distance maintained therefrom, and rotated in a direction opposite to a rotating direction of the photosensitive member, thereby to remove a surplus developing solution which exists on the photosensitive member after development, and a second squeeze roller provided in contact with the photosensitive member, and rotated in the same direction as the photosensitive member with no speed difference therebetween as the photosensitive member rotates, thereby to remove a solvent contained in a toner image formed by developing the latent image; and a press roller in contact with a predetermined position of an outer circumferential surface of the photosensitive member, to transfer the toner image formed on the photosensitive member to a transfer medium.

Also, the present invention provides an image forming apparatus for developing a latent image on a photosensitive member with use of a liquid developer in which toner grains are dispersed in a solvent and for transferring a toner image formed on the photosensitive member to an intermediate transfer medium or a transfer medium by means of a heat, a pressure, or a heat and a pressure, the apparatus comprising: a developing apparatus including a first squeeze roller for removing a surplus developing solution film on a non-image portion on the photosensitive member after development and a second squeeze roller for removing a solvent contained in a developed toner layer, the first squeeze roller faced to the photosensitive member with a predetermined distance maintained therefrom and rotated in a direction opposite to a'rotating direction of the photosensitive member, and the second squeeze roller arranged in contact with the photosensitive member and rotated in the same direction as the photosensitive member with no speed difference therebetween.

Further, the present invention provides an image forming apparatus which contains a liquid developer in which toner grains are dispersed in a solvent and which develops a latent image formed on a photosensitive member, the apparatus comprising: a first squeeze roller faced to the photosensitive member with a predetermined distance maintained therefrom, and rotated in a direction opposite to a rotating direction of the photosensitive member, thereby to remove a surplus developing solution which exists on the photosensitive member after development; and a second squeeze roller provided in contact with the photosensitive member, and rotated in the same direction as the photosensitive member with no speed difference therebetween as the photosensitive member rotates, thereby to remove a solvent contained in a toner image formed by developing the latent image.

DETAILED DESCRIPTION OF THE INVENTION

An embodiment according to the present invention will be explained below with reference to the drawings.

Figure 1:
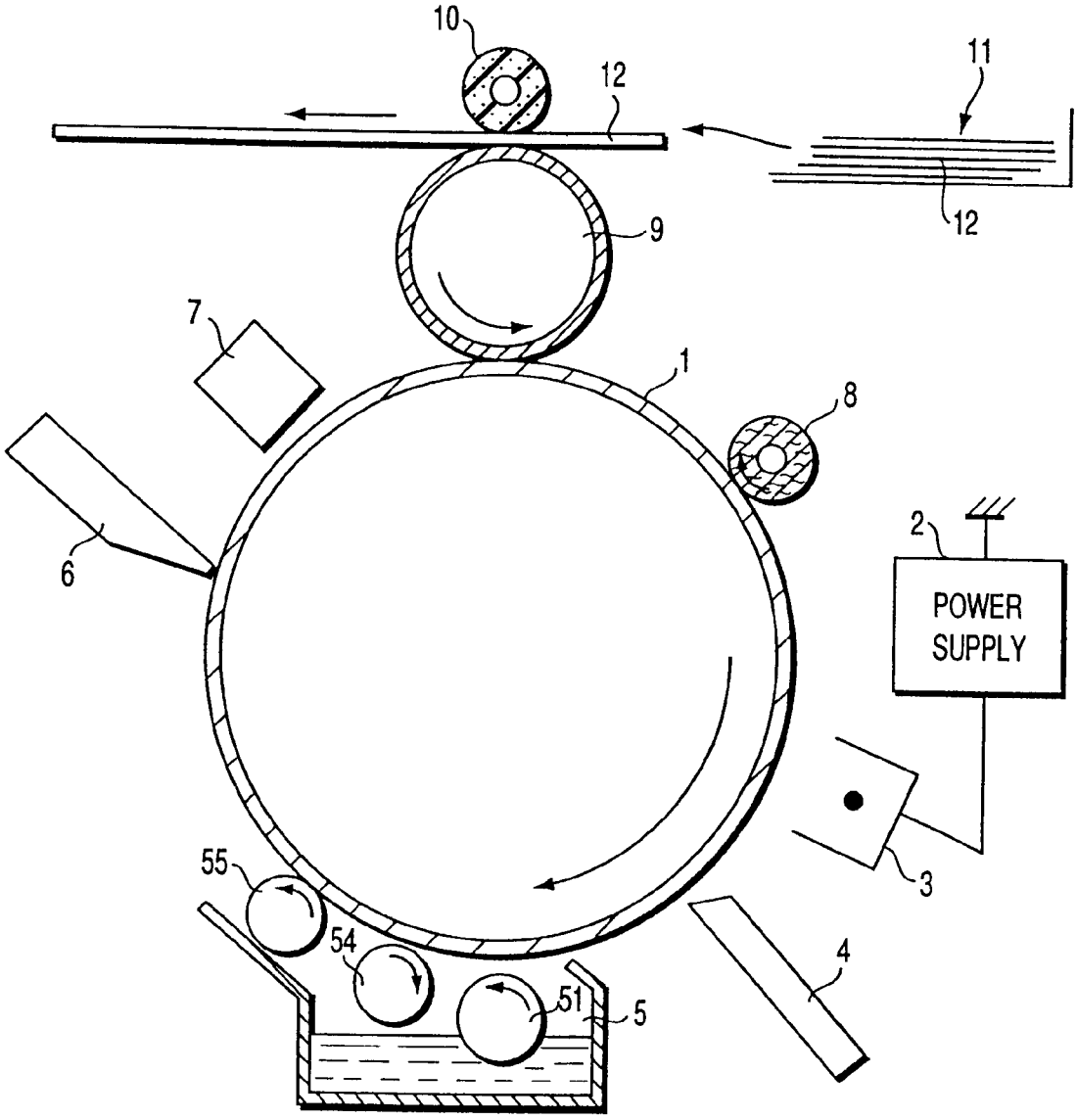
FIG. 1 is a schematic view illustrating a wet image forming apparatus to which an embodiment of the present invention is applied.

FIG. 1 is a schematic view showing a wet electrophotographic apparatus comprising a wet developing apparatus according to the embodiment of the present invention.

A photosensitive member 1 is constructed by forming an optical semiconductor layer having predetermined thickness on a ring-like or sheet-like base member made of aluminum or the like and is uniformly charged to, for example, 600 V by a charging roller or a electrification charger 3 connected to a power source device 2. The photosensitive member 1 is rotated at a predetermined rotation speed by a drum motor not shown.

A latent image corresponding to image information is formed on the photosensitive member 1 charged to the predetermined potential, by irradiating light corresponding to the image information to be outputted by means of a known exposure device 4 such as a laser beam exposure device or a line LED or the like.

A developing apparatus 5 comprises a developing roller 51 faced to an outer circumferential surface of the photosensitive member 1 with a distance of 50 to 200 $\mu$m maintained therebetween, and supplies toner as a developer selectively to a latent image formed on the photosensitive member 1. The developing roller 51 is rotated at a predetermined rotation speed by a developing motor not shown or by the drum motor that rotates the photosensitive member 1 and a rotation transmission mechanism. The developing apparatus 5 is a wet developing apparatus which uses a developing solution in which toner and a charge support agent are dissolved in a solvent as will be explained later with reference to FIG. 2.

At a predetermined position in the downstream side of the developing apparatus 5 along the direction in which the photosensitive member 1 is rotated, there is provided a drying blower 6 for a toner solution (developing solution) supplied onto the photosensitive member 1 by the developing apparatus 5 and a remaining portion of solvent in the toner.

At a predetermined position in the downstream side of the blower 6 along the direction in which the photosensitive member 1 is rotated, a discharger 7 which erases a remaining electric potential on the photosensitive member 1 and an electric charge included in the toner adhere to the photosensitive member 1 by an electrostatic force, and a cleaning device 8 which removes the toner remaining on the photosensitive member 1 are provided in order along the rotating direction of the photosensitive member 1. The discharger 7 may be located in the rear of an intermediate transfer member 9 or the cleaning device 8. The intermediate transfer member 9 temporarily holds a toner (image) whose solvent component has been eliminated by the blower 6, in form of a mirror image, to transfer the toner (image) to, for example, a transfer sheet as an output transfer medium. The intermediate transfer member 9 is rotated at a predetermined rotation speed by an intermediate transfer motor not shown or the drum motor that rotates the photosensitive member 1 and the rotation transmission mechanism.

At a position on the outer circumferential surface of the intermediate transfer member 9 (the position different from the area where the photosensitive member 1 and the intermediate transfer member 9 contact each other), a backup roller 10 is provided and positioned such that a part of the outer circumferential surface contacts the outer circumferential surface of the intermediate transfer member 9. The backup roller 10 is pressed against the outer circumferential surface of the intermediate transfer member 9 with a predetermined pressure, so that the roller 10 is rotated at a speed equal to the moving speed of the outer circumferential surface of the intermediate transfer device 9 such that both the roller 10 and the device 9 are rotated in one same direction at the position where both the roller and the member contact each other.

In the above-described image forming apparatus, image information corresponding to an image to be outputted is exposed as brightness and darkness of light by the exposure device 4, onto the photosensitive member 1 previously charged to a predetermined potential by the charger 3, thereby forming an electrostatic latent image on the photosensitive member 1.

The electrostatic latent image formed in the photosensitive member 1 is developed and visualized by selectively supplying toner at the developing position where the developing apparatus 5 and the photosensitive member 1 are faced to each other.

From the toner supplied onto the photosensitive member 1 during the developing step, a solvent component is removed by the blower 6 and a charge is erased by the discharger 7. The toner is thereafter transferred to the outer circumferential surface of the intermediate transfer member 9 at the transfer position where the toner faces the intermediate transfer member 9.

The toner (image) transferred to the outer circumferential surface of the intermediate transfer member 9 is further transferred to an output transfer material 12 supplied from a transfer material container section 11 such as a paper cassette, at a transfer area where the intermediate transfer member 9 is in contact with the backup roller 10.

To the transfer material 12 to which the toner image has been transferred, the toner image is fixed by a fixing device not shown, which serves to fix a toner (image) to a transfer material 12 by heating the toner and the transfer material to melt the toner. The toner image can be fixed and transferred at the same time by heating the backup roller 10. In this case, it is not necessary to provide the fixing device onto which the toner (image) is fixed. The material 12 is then conveyed to a predetermined position.

Figure 2:
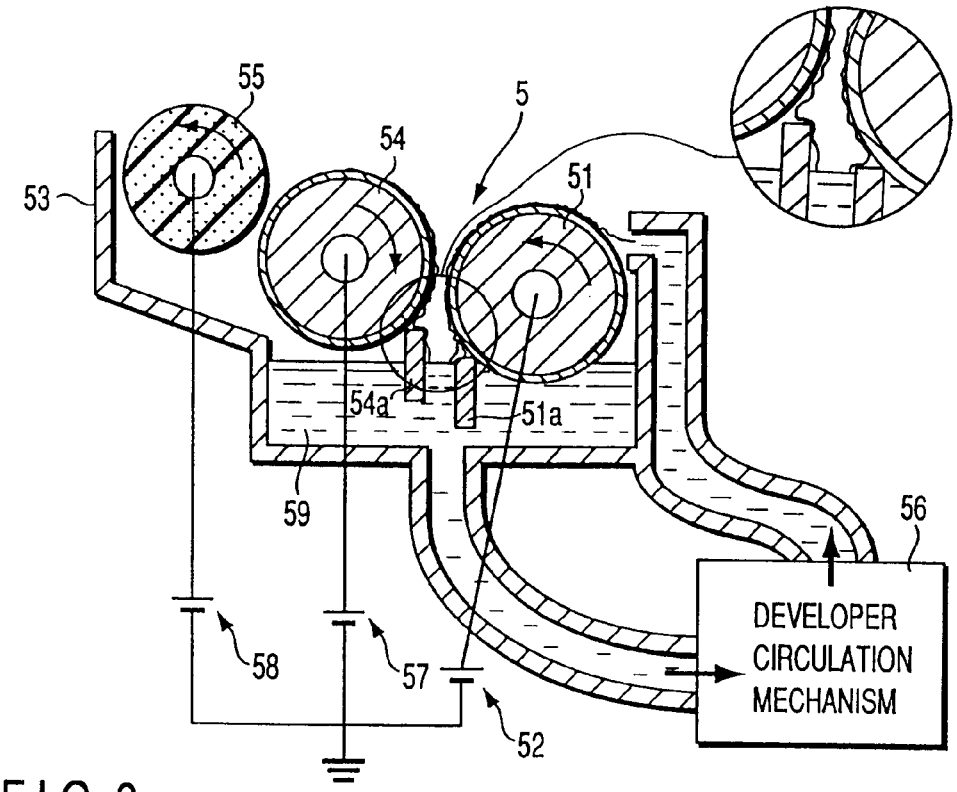
FIG. 2 is a partially cut-away enlarged schematic view showing a liquid developing apparatus incorporated in the image forming apparatus shown in FIG. 1.

FIG. 2 is a partially cut-away enlarged schematic view explaining a developing apparatus incorporated in the wet electrophotographic apparatus shown in FIG. 1.

The developing roller 51 is provided so as to face the photosensitive member 1 with a gap of 50 to 200 $\mu$m maintained from the outer circumferential surface of the photosensitive member 1. The developing roller 51 is rotated such that the outer circumferential surface of the developing roller 51 is moved in the same direction as the photosensitive member 1, at the position where this roller 51 is faced to the photosensitive member 1, at the speed of 0.2 to 4 times faster than the speed at which the outer circumferential surface of the member 1 is rotated. A developing bias voltage of 100 to 600 V is applied to the surface of the developing apparatus 51 by a power source device 52.

The developing roller 51 is contained in a housing 53. First and second squeeze rollers 54 and 55 for squeezing the developing solution supplied to the photosensitive member from the developing roller 51 are provided at predetermined positions in the housing 53 along the rotating direction of the photosensitive member 1. A developing solution circulation mechanism 56 is connected to the housing 53.

In an outer circumferential part of the developing roller 51, at a predetermined position of the developing roller 51 after passing the developing position facing the photosensitive member 1, a developing solution scraper blade 51*a* is provided to remove the developing solution sticking to the surface of the developing roller 51 therefrom. Likewise, in the outer circumferential part of the first squeeze roller 54, at a predetermined position of the first squeeze roller 54 after passing a squeezing position facing the photosensitive member 1, a second developing solution scraper blade 54*a* is provided to remove the developing solution sticking to the surface of the first squeeze roller 54 therefrom. The developing solution removed from the roller surface by each of the developing solution scraper blades 51*a* and 54*a* is used for a next development which the developing roller 51 conducts by the developing solution circulation mechanism 56.

The first squeeze roller 54 is faced to the photosensitive member 1 with a gap of 30 to 100 $\mu$m maintained therebetween, which is narrower than the gap defined between the developing roller 51 and the photosensitive member 1. The first squeeze roller 54 is rotated at a predetermined rotation speed, by a squeeze roller motor not shown or by a developing motor for rotating the developing roller 51 and a rotation transmission mechanism or a drum motor for rotating the photosensitive member 1 and a rotation transmission mechanism, such that the first squeeze roller 54 has a moving speed which is 1 to 4 times (or 1.5 to 5 times) faster than the moving speed of the outer circumferential surface of the photosensitive member 1, at the position where the roller 54 faces the photosensitive member 1, in the direction opposite to the direction in which the outer circumferential surface of the photosensitive member 1 is moved. A voltage of 100 to 600 V is preferably applied to the first squeeze roller 54 by a power source device 57.

The second squeeze roller 55 is made of an electrically conductive elastic material and is let contact the outer circumferential surface of the photosensitive member 1 under a predetermined pressure or at a predetermined interval so as to have a nip width of 1 to 2 mm, for example, with respect to the photosensitive member 1. In this manner, in accordance with rotation of the photosensitive member 1, the second squeeze roller 55 is rotated together with the rotation of the photosensitive member 1 at the same speed as the speed at which the outer circumferential surface of the photosensitive member 1 is moved. A voltage of, for example, 400 to 800 V is applied to the second squeeze roller 55 by the power source device 58. The nip width shows the length of the outer circumferential surface of the elastic second squeeze roller that is deformed by contact of the second squeeze roller 55 having elasticity with the photosensitive member 1.

A developing tank 59 containing a developing solution in which toner is dispersed in a solvent is defined at a predetermined area in the housing 53 of the developing apparatus 5.

The developing solution is prepared by dispersing toner having a grain size of about 0.5 to 3 $\mu$m and consisting of pigment and resin and a charge support agent in a petroleum-based solvent. In the present embodiment, the toner is charged positively by the charge support agent. Although the toner may be charged either positively or negatively, toner is charged normally to a specific polarity depending on the charging characteristic of the optical semi-conductor of the photosensitive member 1, the exposure method, and the like.

Next, the operation of the developing apparatus 5 will be explained in detail with reference to FIGS. 2, 3A, 3B and 3C.

Figure 3A:
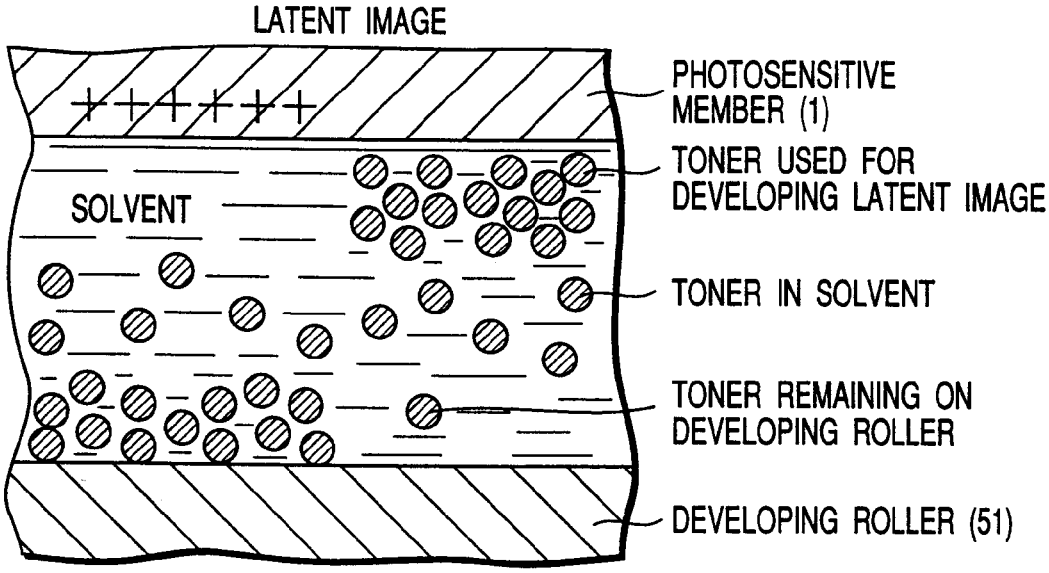
FIG. 3A is a schematic view explaining the state of toner contained in a developing solution existing between a developing roller and a photosensitive member of the developing apparatus shown in FIG. 2.

In the developing apparatus 5, a developing solution in which toner and a charge support agent are dissolved in a solvent is fed to a gap at the developing position where the developing roller 51 and the photosensitive member 1 are faced to each other by rotation of the developing roller 51 and/or a spout force of the developing solution circulation mechanism 56 (pump). The toner in the developing solution (toner solution) sticks selectively to and develops a latent image by an electric field generated by an electric potential of the charge potential applied to the photosensitive member 1 (surface electric potential of the photosensitive member 1) and a developing bias voltage. At this time, the toner above non-image portions sticks to the surface of the developing roller 51 by receiving an electric field force in the direction opposite to the direction in which the photosensitive member 1 receives an electric field force, as shown in FIG. 3A.

The toner above the non-image portions, which has been sticking to the surface of the developing roller, is conveyed in the housing 53 by the rotation of the developing roller 51 and scraped off by the developing solution scraper blade 51*a*. The toner is then circulated into the circulation mechanism 56 in the housing 53. In this manner, at the developing position where the developing roller 51 and the photosensitive member 1 are faced to each other, a fixed amount of toner solution having a toner density which does not change in the solvent (i.e., the toner is not decreased by developing operation of letting toner stick to a latent image) is circulated constantly. Although FIG. 2 shows an embodiment in which the scraper blade 51*a* is used, the cleaning rollers 69, 79, 89 and 99 may be used as in the example shown in FIG. 5.

Figure 3B:
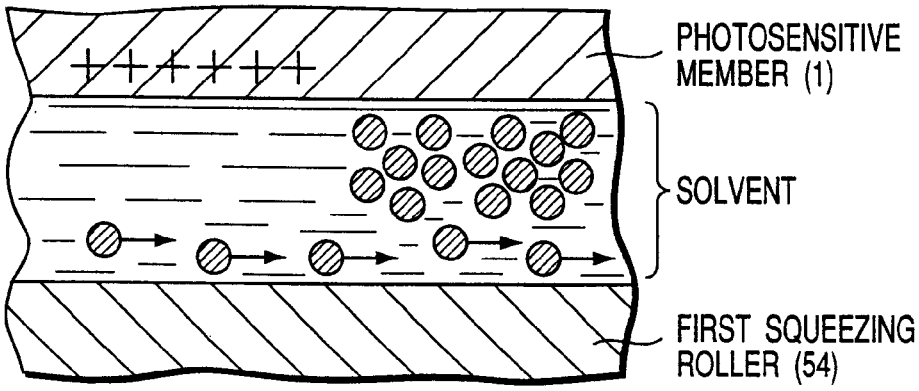
FIG. 3B is a schematic view explaining a principle on which a solvent is removed by a first squeeze roller of the developing apparatus shown in FIG. 2.

The photosensitive member 1, onto which a latent image has been developed by toner fed selectively thereto by the developing roller 51, is conveyed to a squeezing area which faces the first squeeze roller 54, as the photosensitive member 1 rotates. At this time, surplus toner and a surplus solvent floating at the gap between the photosensitive member 1 and the squeeze roller 54 is pushed back toward developing roller 51 along the outer circumferential surface of the photosensitive member 1 as shown in FIG. 3B, and is thus removed from the photosensitive member 1 and returned to the tank 59 in the housing 53. The toner solution which has been returned to the tank 59 is circulated by the circulation mechanism 56 and is used for a subsequent development, as explained previously.

The outer circumferential surface of the photosensitive member 1 from which surplus solvent and toner have been removed by the first squeeze roller 54 is conveyed to a nip area where the second squeeze roller 55 and the photosensitive member 1 are in contact with each other, as the photosensitive member 1 rotates.

Figure 3C:
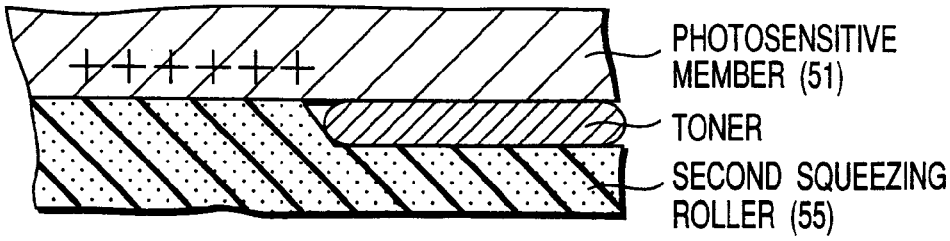
FIG. 3C is a schematic view explaining a principle on which a solvent between toner grains of the toner image is removed by a second squeeze roller of the developing apparatus shown in FIG. 2.

Since the second squeeze roller 55 is let contact with the outer circumferential surface of the photosensitive member 1 with a predetermined pressure as shown in FIG. 3C, the second squeeze roller 55 squeezes out each of a small amount of solvent, which is not squeezed or removed at the gap between the first squeeze roller 54 and the photosensitive member 1 but remains on non-image portions of the outer circumferential surface of the photosensitive member 1, and a solvent contained between grains of the toner sticking to the latent image.

Hence, only a very small amount of solvent remains on the outer circumferential surface of the photosensitive member 1 passed through the nip area where the second squeeze roller 55 contacts the photosensitive member 1.

Thereafter, the toner (image) on the photosensitive member 1, from which a residual solvent has been substantially removed by the second squeeze roller 55, is dried to a desired degree by the rotation of the photosensitive member 1, at a drying area where hot air is blown from the drying blower 6. An electrostatic adsorption force of the toner for the photosensitive member 1 is negligibly small since they are subjected to drying.

The toner (image) conveyed to the transfer area is transferred onto the surface of the intermediate transfer member 9 by the pressure between the intermediate transfer member 9 and the photosensitive member 1 and the difference in adhesion for the toner between the surfaces of these members.

The toner (image) transferred to the intermediate transfer member 9 is further transferred, at a predetermined position on the outer circumference of the intermediate transfer member 9, to a paper sheet 12 fed to an output transfer area between the back up roller 10 and the member 9 from the cassette 11 at a predetermined timing, by the pressure between the intermediate transfer member 9 and back up roller 10.

Then, the paper 12 to which the toner (image) has been transferred is conveyed to the fixing device not shown and the toner is transferred to the paper 12 by pressure and heat. In this case, the fixing advice is not needed in the case where at the transferring time, the toner is transferred and fixed at the same time by pressurizing and heating the contact area between the intermediate transfer member 9 and the back up roller 10.

Thereafter, the paper sheet 12 to which the toner (image) has been transferred is conveyed to a fixing device not shown, and the image is further transferred to the paper sheet 12 by a pressure and a heat.

Figure 4:
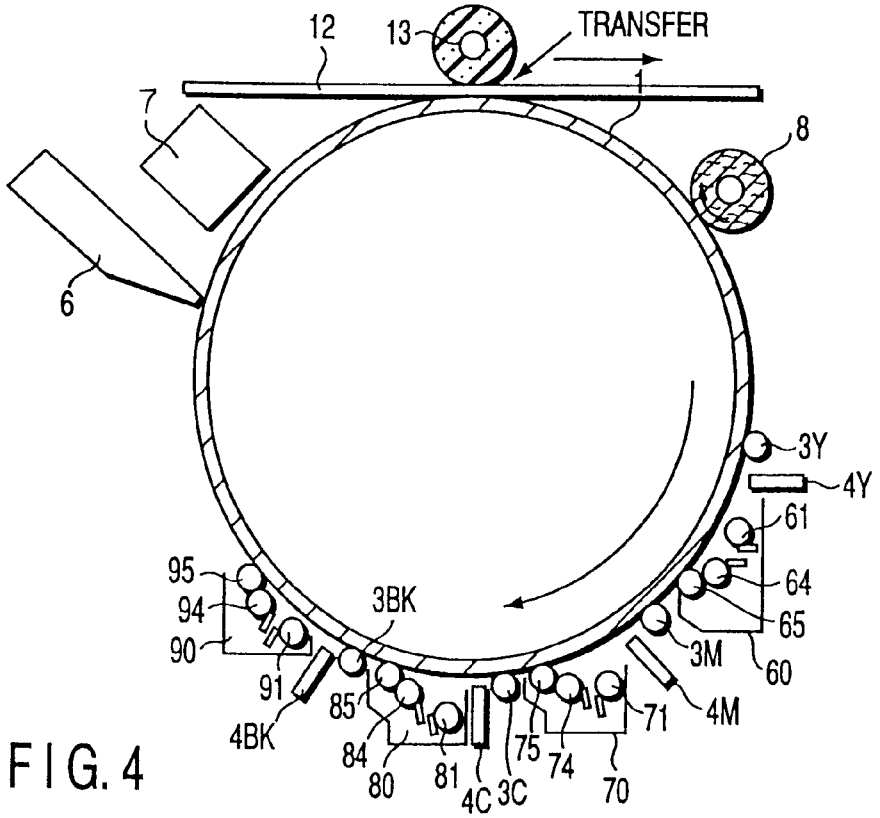
FIG. 4 is a schematic view explaining another embodiment of the image forming apparatus shown in FIG. 1.

Although an image forming apparatus according to an offset-to-offset transfer method has been explained as an example in FIG. 1, an image forming apparatus according to a direct offset transfer method which does not use the intermediate transfer member 9 can also be achieved easily as shown in FIG. 4.

Next, each structure of the developing apparatus 5 shown in FIG. 2 will be explained in detail.

The developing roller 51 is a metal roller made of known material such as stainless steel or the like. It is preferable to provide a thin insulation film made by Kanigen plating, tufram treatment (trade name), fluorine coating, or the like on the surface of the developing roller 51, to prevent the developing bias voltage from causing an electric discharge with respect to the photosensitive member 1.

The first squeeze roller 54 is a metal roller made of known material such as a stainless steel or the like. However, it is also preferable to provide a thin insulation film made by Kanigen plating, turfram treatment, fluorine coating, or the like on the surface of the developing roller 51, to prevent the bias voltage supplied by the power source device 57 from causing an electric discharge with respect to the photosensitive member 1 like the developing roller 51.

The developer (toner solution) is charged positively by using a mixture of known resin and pigment for wet electrophotographic use at a ratio of 4:1 to 1:1, as toner having a grain diameter of 0.1 to 3 $\mu$m or preferably 0.5 to 2 $\mu$m, in a petroleum-based non-polar solvent, with known metal soap such as naphthene acid, octane acid, heptane acid, zirconium salt of stearin acid, manganese salt, nickel salt, iron salt, cobalt salt, zinc salt, any combinations of these acids and salts or the like used as a charge support agent. The toner solution is prepared by dispersing the above toner and charge support agent in a solvent such that the solid content is 0.1 to 5 weight %. Also, the toner solution may contain a dispersion support agent which assists dispersion of pigment in resin, a charge adjust agent which adjusts the charge amount of toner, and the like.

The second squeeze roller 55 is prepared by shaping rubber having conductivity whose resistivity is controlled to about $10^7$ to $10^{12}$ $\Omega$cm into a roller-like form and is made of known resin such as polyurethane or elastic material. A protect layer such as a silicon tube having solvent resistance may be provided on the surface. The rubber hardness and contact pressure should preferably be arranged such that the contact nip is 1 to 2 mm or less.

A toner solution is prepared as follows. Using ISOPER L (manufactured by EXXON) as a non-polar solvent, toner is composed of methylmethacrylate-butylacrylate copolymer resin having a glass transition point Tg of 50° C. and pigment (blue-based). A dispersion agent or the like is added thereto, and mixture and dispersion are carried out together with ISOPER L, by a paint shaker with a glass beam inserted therein, to obtain a concentrated developing solution. Thereafter, the solution is diluted such that the density of the non-volatile component becomes 1 weight part. This diluted solution is added such that the naphthenic acid zirconium (manufactured by DAINIPPON INK AND CHEMICALS, Inc.) becomes 10 weight parts with respect to the amount of the nonvolatile component of the above liquid developing solution.

Cyanine blue KRO (manufactured by SANYO COLOR WORKS, Ltd.) is used as pigment forming part of the toner, and the weight ratio between resin and pigment is set to 4:1.

An image was formed by an experimental equipment, using the liquid developing solution (toner solution) prepared as above where the process speed (moving speed of the outer circumferential surface of the photosensitive member 1) was set to 220 mm per second. At this time, an organic photosensitive layer was prepared on the surface of a aluminum-made drum with a diameter of 150 mm in the photosensitive member 1, and a drum-like photosensitive member provided with a silicone-based hard coat layer of about 1 $\mu$m was used for the most surface. The surface of the photosensitive member 1 was charged to 800 V by using scorotron charger (charger 3), and an electrostatic latent image was formed on the surface of the photosensitive drum by a semiconductor laser set up such that the electric potential at the portion (on the surface of the photosensitive member 1) exposed by an exposure device 4 was at 100 V.

The developing roller 51 was defined as a metal roller of 17 mm in diameter, and the gap between the surface of the photosensitive member 1 was set to 150 $\mu$m. The developing roller 51 was rotated in the same direction as the photosensitive member 1 with no circumferential speed difference (in a state where the moving speed of the outer circumferential surface of the photosensitive member 1 was equal to that of the developing roller). At this time, a voltage of 500 V was applied to the outer circumferential surface of the developing roller 51.

In the condition described above, a stainless steel roller of 17 mm in diameter was used for the first squeeze roller 54 and the gap between the surface of the photosensitive member 1 was set to 50 $\mu$m. The first squeeze roller 54 was rotated in the direction opposite to that of the rotating direction of the photosensitive member 1, at a circumferential speed ratio of 2.5. Further, a voltage of 300 V is applied to the roller surface.

Meanwhile, the second squeeze roller 55 was a elastic roller in which urethane-based conductive rubber having resistivity of about $10^8$ Ωcm was wound around a core rod made of, for example, stainless steel and a silicon-based rubber tube was provided as a solvent resistance protect layer on the outer circumferential surface. The outer diameter including the tube made of silicon was set to about 20 mm. In addition, the second squeeze roller 55 was pressed toward the center of the photosensitive member 1 to obtain a nip amount of 1 mm that was defined by the contact with the photosensitive member 1. The second squeeze roller 55 was a non-driven roller and was rotated without a circumferential speed difference (at the same moving speed as the outer circumferential surface of the photosensitive member 1) at the position where it contacts the photosensitive member 1, in the same direction as the photosensitive member 1. A voltage of 800 V was applied to the surface of the silicone tube.

In the above condition, although air was blown by the drying blower 6, only the solvent was removed from the surface of the photosensitive member 1 and the formed toner image (obtained by developing the latent image with toner) was dried to a desired degree such that no remaining solvent stuck to the intermediate transfer member 9 without distorting the image nor causing defects by air, since the formed toner image was fixed to the surface of the photosensitive member 1 by the second squeeze roller 55. The drying blower 6 serves to blow unheated air and the air volume blown from an opening portion to the photosensitive member 1 is 5 m/sec.

The intermediate transfer member 9 was an elastic cylindrical member having a diameter of about 104 mm and was made by forming an urethane rubber layer having hardness of 20° hardness according to the JIS-A scale on a metal roller having a diameter of 100 mm with thickness of 2 mm. This member 9 was pressed into contact with the photosensitive member 1 with a load of 5 kg per $cm^2$ in use. Hence, the toner image formed on the photosensitive member 1 was transferred to the outer circumferential surface of the intermediate transfer member 9 substantially without remaining toner (primary transfer).

Thus, substantially the entire of the toner image transferred to the intermediate transfer member 9 was transferred to the paper sheet 12 at the output transfer part where the backup roller 10 and the intermediate transfer member 9 contact each other (secondary transfer). The backup roller 10 was such an elastic roller that was made by forming an urethane rubber layer having hardness of 50° according to the JIS-A scale on a metal shaft or metal roller to have had a diameter of 100 mm and was used in a state where the surface was heated at 80°. The backup roller 10 was pressed to the intermediate transfer member 9 with a load of 8 $kg/cm^2$.

The toner image (output image) obtained as described above on the paper sheet 12 had sharp edges and satisfied 1 dot line pair. Although 1000 sheets of paper were outputted continuously, image deterioration such as decrease of the image density, turbulence (defect) of the toner image, or the like was not confirmed and excellent images could be obtained.

FIG. 4 is a schematic view explaining an example in which a full-color image forming apparatus is constructed by arranging four sets of wet developing apparatuses explained with reference to FIGS. 1 to 3 around the photosensitive member 1. Structural components which are the same or similar to those explained with reference to FIGS. 1 to 3 are designated at the same reference symbols (or by equal first digits). Components provided for four colors are respectively added with Y, M, C and BK to distinguish these components from each other and the detailed description thereof will be omitted herefrom.

In the color image forming apparatus shown in FIG. 4, first to third developing apparatuses 60, 70, and 80 which maintain toner solutions includes pigments for showing Y (yellow), M (magenta) and C (cyan) as three color components use in the subtractive primaries to form images in corresponding colors, respectively, and a fourth developing apparatus 90 which maintains a BK toner solution to emphasize BK (black) and to provide a black image in one single color are provided in order around the photosensitive member 1 along the rotating direction of the photosensitive member 1. First to fourth charging devices 3Y, 3M, 3C, and 3BK which apply predetermined potentials to the photosensitive member 1 are respectively provided in the upstream sides of the photosensitive member 1 in the rotating direction thereof. Also, first to fourth exposing devices 4Y, 4M, 4C and 4BK are provided between the chargers and developing apparatuses for corresponding colors, respectively. In case where each exposing device is a laser beam exposing device, for example, needless to say, the shapes and layout of the exposing devices can be realized by any structure, as long as image information can be exposed between the charging device and the developing apparatus by a laser beam to be finally outputted each exposing device.

The developing apparatuses 60, 70, 80 and 90 respectively include the developing rollers 61, 71, 81 and 91 which are faced to the outer circumferential surface of the photosensitive member 1 at a predetermined interval of 50 to 200 μm, first squeeze rollers 64, 74, 84 and 94, which are faced to outer circumferential surface of the photosensitive member 1 at a predetermined distance and second squeeze rollers 65, 75, 85 and 95 which are in contact with the outer circumferential surface of the photosensitive member 1, developing solution scraper blades 64*a*, 74*a*, 84*a*, 94*a*, 65*a*, 75*a*, 85*a* and 95*a* are provided for the second squeezes 64, 65, 74, 75, 84, 85, 94 and 95 respectively.

The developing apparatus 60, 70, 80 and 90 respectively four color toners of Y, M, C, and BK prepared as follows. Each of the toners is prepared by mixing toner powder and ISOPER L (manufactured by EXXON). A dispersion agent or the like is added thereto. Mixing and dispersion are carried out together with ISOPER L by a paint shaker with a glass beam inserted, to obtain a concentrated developing solution. Thereafter, the solution is diluted such that the density of the non-volatile component becomes 1 weight part. The diluted solution is added to a toner solution such that the naphthenic acid zirconium (manufactured by DAINIPPON INK AND CHEMICALS, Inc.) becomes a 10 weight part with respect to the amount of non-volatile component of the above-described liquid developer. In the toner solution thus obtained, yellow-based KET Yellow 402 (manufactured by DAINIPPON INK AND CHEMICALS, Inc.), magenta-based KET Red 301 (manufactured by DAINIPPON INK AND CHEMICALS, Inc.), cyan-based Cyanine blue KRO (manufactured by SANYO COLOR WORKS, Ltd.), and black #750B (manufactured by MITSUBISHI CHEMICAL CORPORATION) pigments are used.

In this image forming apparatus as described above, the photosensitive member 1 is charged to a predetermined electric potential by the charger 3Y, and a latent image for yellow (Y) is formed by the exposing device 4Y. The Y latent image is developed by the Y toner solution supplied from the developing apparatus 60, and a Y toner image is formed on the photosensitive member 1. At this time, a surplus of the toner solution supplied to the Y latent image of the photosensitive member 1 by the developing apparatus 61 of the developing apparatus 60 is removed from the surface of the photosensitive member 1 by the developing roller 61 and the first squeeze roller 64. Further, the second squeeze roller 65 removes the solvent remaining on the surface of the photosensitive member 1 and in gaps in the toner of the Y toner image.

Subsequently, the photosensitive member 1 on which the Y toner image has already been formed is charged to a predetermined electric potential by the charger 3M, and a latent image for Magenta (M) is formed by the exposing device 4M. The M latent image is developed by the M toner solution supplied from the developing apparatus 70, and a N toner image is formed on the photosensitive member 1, layered on the Y toner image or at a predetermined position. At this time, a surplus of the toner solution supplied to the M latent image on the photosensitive member 1 by the developing roller 71 of the developing apparatus 70 is removed from the surface of the photosensitive member 1 by the developing roller 71 and the first squeeze roller 74. The second squeeze roller 75 removes the solvent remaining on the surface of the photosensitive member 1 and in gaps in the toner of the M toner image.

Next, the photosensitive member 1 on which the Y toner image and the M toner image have already been formed is charged to a predetermined electric potential by the electrostatic charger 3C, and a latent image for Cyan (C) is formed by the exposing device 4C. The C latent image is developed by the C toner solution supplied from the developing apparatus 80, and a C toner image is formed on the photosensitive member 1, layered on the Y toner image and the M toner image or at a predetermined position. At this time, a surplus of the toner solution supplied to the C latent image on the photosensitive member 1 by the developing roller 81 of the developing apparatus 80 is removed from the surface of the photosensitive member 1 by the developing roller 81 and the first squeeze roller 84. The second squeeze roller 85 removes the solvent remaining on the surface of the photosensitive member 1 and in gaps in the toner of the C toner image.

Subsequently, the photosensitive member 1 on which the Y toner image, M toner image, and C toner image have already been formed is charged to a predetermined electric potential by the electrostatic charger 3BK, and a latent image for Black (BK) is formed by the exposing device 4BK. The BK latent image is developed by the BK toner solution supplied from the developing apparatus 90, and a BK toner image is formed on the photosensitive member 1, layered on the Y toner image, the M toner image, and the C toner image or at a predetermined position. At this time, a surplus of the toner solution supplied to the BK latent image of the photosensitive member 1 by the developing roller 91 of the developing apparatus 90 is removed from the surface of the photosensitive member 1 by the developing roller 91 and the first squeeze roller 94. The second squeeze roller 95 removes the solvent remaining on the surface of the photosensitive member 1 and in gaps in the toner of the BK toner image.

As described above, after the solvent components are removed by the blower 6, electric charges are erased from the four color toners formed on the photosensitive member 1, by the discharger 7, and the toners are transferred to the paper sheet 12 which is conveyed between an output transfer press roller 13 and the photosensitive member 1.

To the transfer material 12 to which the toner images have been transferred, the toner images are fixed by a fixing device not shown for fixing toner images to the transfer material 12 by heating and melting the toners and the transfer material and by applying a pressure thereto.

Thus, by a full-color image forming apparatus in which four developing apparatuses 60, 70, 80, and 90 respectively containing toner solutions for four colors are arranged in order around the photosensitive member 1 along the rotating direction of the photosensitive member 1, images of YELLOW (Y), MAGENTA (M), CYAN (C) and BLACK (BK) sequentially are layered on the photosensitive layer and are transferred at once to a paper sheet 12, with respect to all four colors, with no developing toners of lower layers peeled off when developing images layered.

Figure 5:
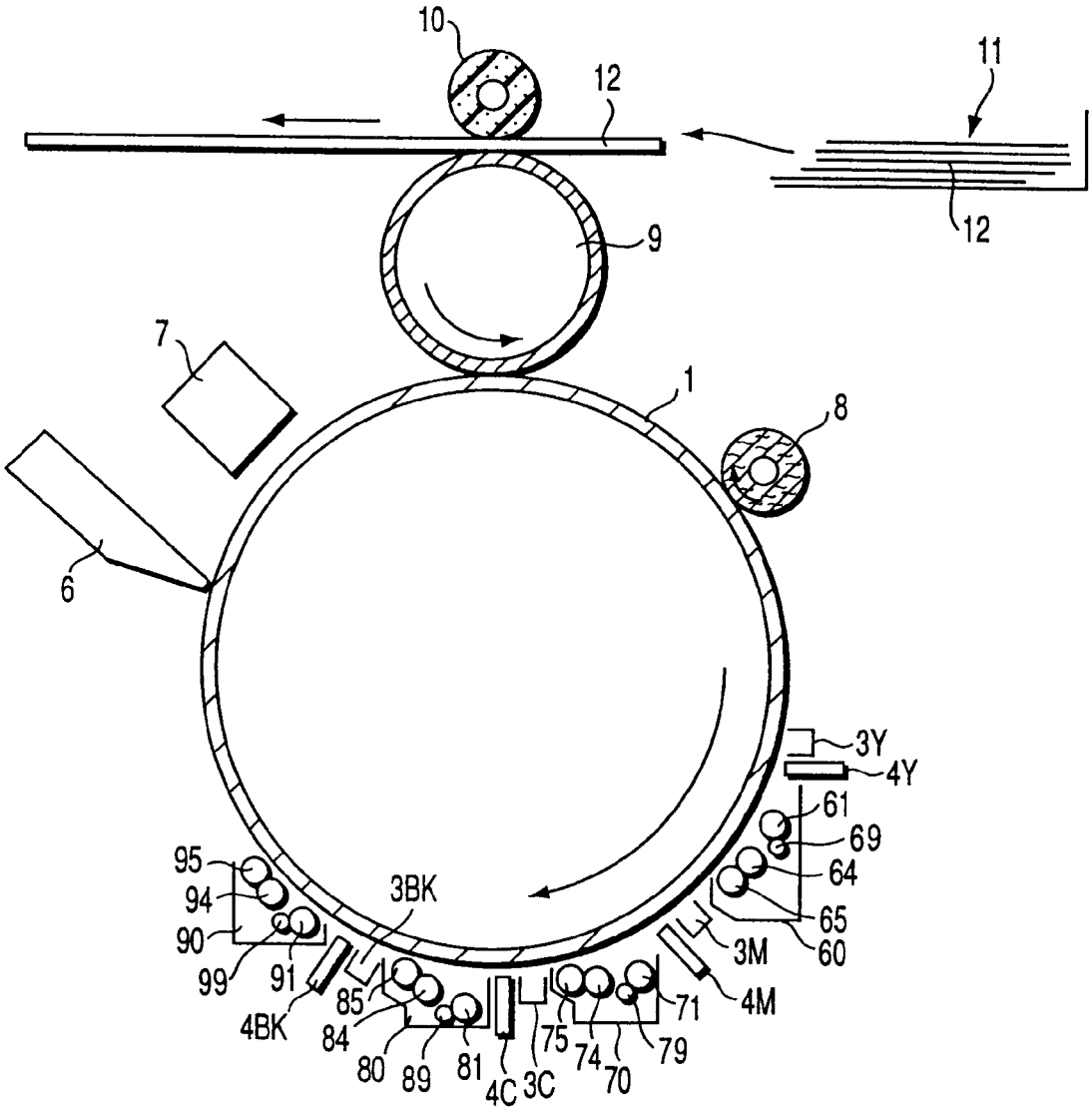
FIG. 5 is a schematic view explaining further another embodiment of the image forming apparatus shown in FIG. 1.

FIG. 5 is a schematic view explaining an example in which the full-color image forming apparatus is constructed by arranging four sets of wet developing apparatuses explained with reference to FIGS. 1 to 3 around the photosensitive member 1. Structural components which are the same or similar to those explained with reference to FIGS. 1 to 4 are designated at the same reference symbols (or by equal first digits). Components provided for four colors are respectively added with Y, M, C and BK to distinguish these components from each other and the detailed description thereof will be omitted herefrom. In the image forming apparatus shown in FIG. 5, a concept of the intermediate transfer similar to that of the image forming apparatus shown in FIG. 1 is added to the image forming apparatus shown in FIG. 4.

In the color image forming apparatus shown in FIG. 4, first to third developing apparatuses 60, 70, and 80 which maintain toner solutions includes pigments for showing Y (yellow), M (magenta) and C (cyan) as three color components to form images in corresponding colors, respectively, and a fourth developing apparatus 90 which maintains a BK toner solution to emphasize BK (black) and to provide a black image in one single color are provided in order around the photosensitive member 1 along the rotating direction of the photosensitive member 1. First to fourth charging devices 3Y, 3M, 3C, and 3BK which are constructed by known charging rollers to apply predetermined potentials to the photosensitive member 1 are respectively provided in the upstream sides of the photosensitive member 1 in the rotating direction thereof. Also, first to fourth exposing devices 4Y, 4M, 4C and 4BK are provided between the chargers and developing apparatuses for corresponding colors, respectively. In case where each exposing device is a laser beam exposing device, for example, needless to say, the shapes and layout of the exposing devices can be realized by any structure, as long as image information can be exposed between the charging device and the developing apparatus by a laser beam to be finally outputted each exposing device.

The developing apparatuses 60, 70, 80 and 90 respectively has the developing rollers 61, 71, 81 and 91 which are faced to the outer circumferential surface of the photosensitive member 1 at an interval of 50 to 200 $\mu$m, toner solution remove rollers 69, 79, 89 and 99 which are brought into contact with the developing rollers to remove surplus toner solutions, first squeeze rollers 64, 74, 84 and 94, which are faced to outer circumferential surface of the photosensitive member 1 at a predetermined distance and second squeeze rollers 65, 75, 85 and 95 which are in contact with the outer circumferential surface of the photosensitive member 1.

The same toner solutions for four colors as explained in FIG. 4 are respectively used for the developing apparatuses 60, 70, 80 and 90.

In this image forming apparatus, the photosensitive member 1 is charged to a predetermined electric potential by the charger 3Y, and a latent image for yellow (Y) is formed by the exposing device 4Y. The Y latent image is developed by the Y toner solution supplied from the developing apparatus 60, and a Y toner image is formed on the photosensitive member 1. At this time, a surplus of the toner solution supplied to the Y latent image of the photosensitive member 1 by the developing apparatus 61 of the developing apparatus 60 is removed from the surface of the photosensitive member 1 by the developing roller 61 the first squeeze roller 64. Further, the second squeeze roller 65 removes the solvent remaining on the surface of the photosensitive member 1 and in gaps in the toner of the Y toner image.

Subsequently, the photosensitive member 1 on which the Y toner image has already been formed is charged to a predetermined electric potential by the charger 3M, and a latent image for Magenta (M) is formed by the exposing device 4M. The M latent image is developed by the M toner solution supplied from the developing apparatus 70, and a M toner image is formed on the photosensitive member 1, layered on the Y toner image or at a predetermined position. At this time, a surplus of the toner solution supplied to the M latent image on the photosensitive member 1 by the developing roller 71 of the developing apparatus 70 is removed from the surface of the developing photosensitive member 1 by the developing roller 71 and the first squeeze roller 74. The second squeeze roller 75 removes the solvent remaining on the surface of the photosensitive member 1 and in gaps in the toner of the M toner image.

Next, the photosensitive member 1 on which the Y toner image and the M toner image have already been formed is charged to a predetermined electric potential by the electrostatic charger 3C, and a latent image for Cyan (C) is formed by the exposing device 4C. The C latent image is developed by the C toner solution supplied from the developing apparatus 80, and a C toner image is formed on the photosensitive member 1, layered on the Y toner image and the M toner image or at a predetermined position. At this time, a surplus of the toner solution supplied to the C latent image on the photosensitive member 1 by the developing roller 81 of the developing apparatus 80 is removed from the surface of the photosensitive member 1 by the developing roller 81 and the first squeeze roller 84. The second squeeze roller 85 removes the solvent remaining on the surface of the photosensitive member 1 and in gaps in the toner of the C toner image.

Subsequently, the photosensitive member 1 on which the Y toner image, M toner image, and C toner image have already been formed is charged to a predetermined electric potential by the electrostatic charger 3BK, and a latent image for Black (BK) is formed by the exposing device 4BK. The BK latent image is developed by the BK toner solution supplied from the developing apparatus 90, and a BK toner image is formed on the photosensitive member 1, layered on the Y toner image, the M toner image, and the C toner image or at a predetermined position. At this time, a surplus of the toner solution supplied to the BK latent image of the photosensitive member 1 by the developing roller 91 of the developing apparatus 90 is removed from the surface of the photosensitive member 1 by the developing roller 91 and the first squeeze roller 94. The second squeeze roller 95 removes the solvent remaining on the surface of the photosensitive member 1 and in gaps in the toner of the BK toner image.

As described above, after the solvent components are removed by the blower 6, electric charges are erased from the four color toners formed on the photosensitive member 1, by the discharger 7, and are conveyed to a transfer area where an intermediate transfer member 9 is faced.

The toner images thus conveyed to the transfer area are transferred to the surface of the intermediate transfer member 9 by the pressure applied between the member 9 and the photosensitive member 1.

The toners (images) transferred to the intermediate transfer member 9 are further transferred to a paper sheet 12, which is conveyed to an output transfer area between a backup roller 10 and the member 9 from a cassette 11 at a predetermined timing, at a predetermined position on the outer circumference of the intermediate transfer member 9, by the pressure between the intermediate transfer member 9 and the backup roller 10.

Subsequently, the paper sheet 12 to which the toners (images) have been transferred is conveyed toward a fixing device not shown, and the toner images are transferred to the paper sheet 12 by a pressure and heat.

Thus, by a full-color image forming apparatus in which four developing apparatuses 60, 70, 80, and 90 respectively containing toner solutions for four colors are arranged in order around the photosensitive member 1 along the rotating direction of the photosensitive member 1, images of YELLOW (Y), MAGENTA (M), CYAN (C) and BLACK (BK) sequentially are layered on the photosensitive layer and are transferred at once to a paper sheet 12, with no developing toners of subbed layers peeled off when developing images layered, with respect to all four colors.

COMPARATIVE EXAMPLE

Prepared was a developing apparatus provided with a developing roller whose gap from the photosensitive member is set to 150 m and a squeeze roller whose gap from the photosensitive member is set to 30 $\mu$m (the second squeeze roller is not provided in comparison with the present embodiment). A toner image was formed. According to this developing apparatus, a surplus solvent was collected and removed without inferiority compared with the developing apparatus explained in the present application. However, it was confirmed that defects partially occurred in the toner (image) formed on the photosensitive member.

That is, the narrower the gap between the squeeze roller and the photosensitive member is, the more the residual amount of the developing solution is reduced. However, it was confirmed that the toner after development was peeled off.

With use of this comparative developing apparatus, an image was formed in an experimental apparatus as shown in FIG. 1. However, a surplus solvent could not be dried out only by the drying blower 6, and the toner image after development could not be primarily transferred to the intermediate transfer member 9. In addition, when the air volume outputted from the drying blower 6 was increased to 20 m/sec, the toner image was drifted to the downwind side (close to the developing apparatus) on the photosensitive member 1.

Meanwhile, the process speed of the comparative developing apparatus was decreased to 100 mm/sec, and a full-color image forming apparatus having a structure as shown in FIG. 4 was constructed. It was confirmed that at the time point when toner images were formed on the photosensitive member in the order of YELLOW (Y), MAGENTA (M), and CYAN (C), toners which had already been developed mixed into the developing devices (M and C) which were to perform development later thereby mixing the colors, and that the toners of the colors to be developed in a later order are more scraped off by the squeeze roller so that desired color reproduction could not be realized.

As described above, the wet electrophotographic apparatus according to the present invention is able to dry rapidly the developed toner images without disturbing the toner images. Hence, the image quality can be improved, and images can be outputted at a high speed without increasing the power consumption.

If the developing gap between the photosensitive member and the developing roller is too wide, electric field concentration is caused. This can be a factor which causes an edge effect (phenomenon that the density at a contour part becomes higher than at a center part in an image having a large solid-painted area) is caused. If the developing gap is too narrow, the developing bias voltage may leak out to the photosensitive member, and the gap should be set to 50 to 200 $\mu$m.

In addition, as described with reference to FIGS. 3A, 3B and 3C, when the developing gap is filled with a solvent, the toner in the developing solution near the latent image sticks to the latent image but the sticking force is weak. In addition, the toner in the developing solution on non-image portions sticks to the developing roller side, but a toner which cannot move by electrophoresis to either the latent image side or the developing roller side floats on the entire surface.

Under this condition, the squeeze roller (first) is faced to the photosensitive member with a narrower gap inserted therebetween than the developing gap and is rotated in the direction opposite to the rotating direction of the photosensitive member, at a speed 1.5 to 5 times higher than the circumferential speed ratio, thereby removing the surplus developing solution on the photosensitive member. Through this step, the floating toner, which has not stuck to the latent image or the developing roller, is removed together with the surplus developing solution.

The second squeeze roller removes a solvent film remaining on non-image portions but containing no toner, and a solvent remaining among the toner grains accumulated on the latent image. At this time, only the solvent can be removed without disturbing the image, by pressing the toner on the latent image against the photosensitive member side. The second squeeze roller does not disturb the image since this roller is rotated at the same circumferential speed as the photosensitive member (with no circumferential speed difference) such that the outer surface is moved in the same direction as the photosensitive member.

However, since the second squeeze roller is in contact with the photosensitive member, it is necessary to perform a low surface energy treatment on the (roller) surface to prevent the toner image from sticking. If the pressure which the second squeeze roller applies to the photosensitive member is too strong, the toner image is pressed and disturbed (lines become fat). Therefore, the contact pressure has an upper limit value.

A solvent on non-image portions is held up by a contact nip, and a solvent among toner grains is squeezed and removed.

According to the present invention, the air volume and temperature of the drying blower can be reduced, and therefore, the process speed can be increased.

Also, if a color image forming apparatus is constructed by arranging a plurality of developing apparatuses as described above around a photosensitive member (drum or belt), most of a surplus solvent is removed from the toner after development of the first color, without containing a solvent, so the toner is fixed stably to the photosensitive member or transfer medium. Therefore, even if charging, exposure, and development are repeated for image formation of the next color, there occurs no drawback that the toner of the first color is taken into the developing apparatus for the second color and the colors are mixed or that the toner of first color is scraped away together by the first squeeze roller, when developing the second color.

Hence, it is possible to adopt a method in which images of four colors as color components of a color image are layered on a photosensitive member and are transferred at once to an output transfer medium.

What is claimed is:

1. An image forming apparatus for developing a latent image on a photosensitive member with use of a liquid developer in which toner grains are dispersed in a solvent and for transferring a toner image formed on the photosensitive member to a transfer medium by means of a heat, a pressure, or a heat and a pressure, the apparatus comprising:

a developing apparatus including a first squeeze roller faced to the photosensitive member with a predetermined distance maintained therefrom, and rotated in a direction opposite to a rotating direction of the photosensitive member, thereby to remove a surplus developing solution which exists on the photosensitive member after development, and a second squeeze roller provided in contact with the photosensitive member, and rotated in the same direction as the photosensitive member with no speed difference therebetween as the photosensitive member rotates, thereby to remove a solvent contained in a toner image formed by developing the latent image; and a press roller in contact with a predetermined position of an outer circumferential surface of the photosensitive member, to transfer the toner image formed on the photosensitive member to a transfer medium, wherein a development roller is arranged closer to the first squeeze roller than the second squeeze roller.

2. An apparatus according to claim 1, wherein the liquid developer includes a liquid developer in which toner containing resin and pigment mixed at a ratio of 4:1 to 1:1 and arranged to have a grain size of 0.1 to 3 $\mu$m or preferably 0.5 to 2 $\mu$m is charged positively in a non-polar petroleum-based solvent, using known metal soap, such as naphthene acid, octane acid, heptane acid, stearin acid, zirconium salt, manganese salt, nickel salt, iron salt, cobalt salt, zinc salt, any combinations of these acids and salts or the like, as a charge support agent.

3. An apparatus according to claim 1, wherein the first squeeze roller of the developing apparatus is rotated at a moving speed which is 0.5 to 5 times higher than a speed at which the outer circumferential surface of the photosensitive member moves.

4. An image forming apparatus according to claim 3, wherein the first squeeze roller of the developing apparatus is rotated at a moving speed which is 1.5 to 4 times higher than a speed at which the outer circumferential surface of the photosensitive member moves.

5. An apparatus according to claim 4, wherein the first squeeze roller of the developing apparatus is rotated at a moving speed which is 2 to 3 times higher than a speed at which the outer circumferential surface of the photosensitive member moves.

6. An apparatus according to claim 1, further comprising an intermediate transfer medium provided between the outer circumferential surface of the photosensitive member and the press roller, to hold temporarily the toner image formed on the photosensitive member and to transfer again the toner image to the transfer medium supplied between the press roller.

7. An apparatus according to claim 6, wherein the intermediate transfer medium has an elastic layer formed on a surface of a metal cylinder.

8. An apparatus according to claim 1, wherein the press roller has an elastic layer formed on a metal shaft.

9. An apparatus according to claim 8, wherein the press roller applies a predetermined pressure toward a center of the photosensitive member.

10. An apparatus according to claim 1, wherein the second squeeze roller of the photosensitive member is pressed against the outer circumferential surface of the photosensitive member with a pressure which provides a nip width of 1 to 2 mm.

11. An image forming apparatus for developing a latent image on a photosensitive member with use of a liquid developer in which toner grains are dispersed in a solvent and for transferring a toner image formed on the photosensitive member to an intermediate transfer medium or a transfer medium by means of a heat, a pressure, or a heat and a pressure, the apparatus comprising:

a developing apparatus including a first squeeze roller for removing a surplus developing solution film on a non-image portion on the photosensitive member after development and a second squeeze roller for removing a solvent contained in a developed toner layer, the first squeeze roller faced to the photosensitive member with a predetermined distance maintained therefrom and rotated in a direction opposite to a rotating direction of the photosensitive member, and the second squeeze roller arranged in contact with the photosensitive member and rotated in the same direction as the photosensitive member with no speed difference therebetween, wherein a development roller is arranged closer to the first squeeze roller than the second squeeze roller.

12. An apparatus according to claim 11, wherein the liquid developer includes a liquid developer in which toner containing resin and pigment mixed at a ratio of 4:1 to 1:1 and arranged to have a grain size of 0.1 to 3 $\mu$m or preferably 0.5 to 2 $\mu$m is charged positively in a non-polar petroleum-based solvent, using known metal soap, such as naphthene acid, octane acid, heptane acid, stearin acids, zirconium salt, manganese salt, nickel salt, iron salt, cobalt salt, zinc salt, any combinations of these acids and salts or the like, as a charge support agent.

13. An image forming apparatus according to claim 11, wherein in a downstream side of an area of the photosensitive member where the latent image is developed by the developing apparatus, in a direction in which the photosensitive member rotates, the transfer medium singly contacts the intermediate transfer medium at a predetermined position or the transfer medium contacts the intermediate transfer medium after the intermediate transfer medium has contacted the photosensitive drum.

14. An apparatus according to claim 11, wherein the first squeeze roller of the developing apparatus is rotated at a moving speed which is 2 to 3 times higher than a speed at which the outer circumferential surface of the photosensitive member moves.

15. An image forming apparatus according to claim 11, wherein the second squeeze roller of the photosensitive member is pressed against the outer circumferential surface of the photosensitive member with a pressure which provides a nip width of 1 to 2 mm.

16. An image forming apparatus which contains a liquid developer in which toner grains are dispersed in a solvent and which develops a latent image formed on a photosensitive member, the apparatus comprising:

a first squeeze roller faced to the photosensitive member with a predetermined distance maintained therefrom, and rotated in a direction opposite to a rotating direction of the photosensitive member, thereby to remove a surplus developing solution which exists on the photosensitive member after development; and a second squeeze roller provided in contact with the photosensitive member, and rotated in the same direction as the photosensitive member with no speed difference therebetween as the photosensitive member rotates, thereby to remove a solvent contained in a toner image formed by developing the latent image, wherein a development roller is arranged closer to the first squeeze roller than the second squeeze roller.

17. An apparatus according to claim 16, wherein the first squeeze roller is rotated at a moving speed which is 2 to 3 times higher than a speed at which the outer circumferential surface of the photosensitive member moves.

18. An according to claim 16, wherein the second squeeze roller is pressed against the outer circumferential surface of the photosensitive member with a pressure which provides a nip width of 1 to 2 mm.

* * * * *